US012467667B2

(12) United States Patent
Yu et al.

(10) Patent No.: US 12,467,667 B2
(45) Date of Patent: Nov. 11, 2025

(54) ORIFICE SET AND CHILLER SYSTEM HAVING IT

(71) Applicant: Carrier Corporation, Palm Beach Gardens, FL (US)

(72) Inventors: Yang Yu, Shanghai (CN); Lihui Yang, Shanghai (CN); Haiping Ding, Shanghai (CN); Qunyi Ma, Shanghai (CN); Rui Ma, Shanghai (CN); Lei Yu, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 229 days.

(21) Appl. No.: 18/178,985

(22) Filed: Mar. 6, 2023

(65) Prior Publication Data

US 2023/0288107 A1 Sep. 14, 2023

(30) Foreign Application Priority Data

Mar. 10, 2022 (CN) ..... 202210231607.5

(51) Int. Cl.
*F25B 41/24* (2021.01)
*F25B 41/315* (2021.01)

(52) U.S. Cl.
CPC ..... *F25B 41/24* (2021.01); *F25B 41/315* (2021.01)

(58) Field of Classification Search
CPC ..... F25B 41/24; F25B 41/315; F25B 41/32; F25B 41/20; F25B 41/30; F25B 1/053
See application file for complete search history.

(56) References Cited

U.S. PATENT DOCUMENTS 1,135,196 A * 4/1915 Krieger ..... F25B 41/315 137/434
1,299,961 A * 4/1919 Krieger ..... F25B 41/315 62/221
1,916,426 A * 7/1933 Green ..... F22B 37/48 122/491
1,981,562 A * 11/1934 Loranger ..... F25B 41/315 62/194
2,062,042 A * 11/1936 Sargent ..... F24F 1/00 392/394

(Continued)

FOREIGN PATENT DOCUMENTS

CA 2878835 A1 * 1/2014 ..... B64D 37/005
CN 2271685 Y * 12/1997

(Continued)

*Primary Examiner* — Kun Kai Ma
(74) *Attorney, Agent, or Firm* — CANTOR COLBURN LLP

(57) ABSTRACT

A throttling device, including a tank for accommodating liquid refrigerant, with an orifice plate arranged at an outlet of the tank; a floating ball capable of floating on a liquid surface of the refrigerant; a pivot rod pivotally fixed on the tank through a pivot shaft; a connecting rod, with one end thereof fixedly connected with the floating ball, and the other end thereof fixedly connected with the pivot rod; a valve plate fixed on the pivot rod and located near an orifice of the orifice plate, wherein the valve plate is capable of adjusting a flow area of the orifice under the action of the pivot rod; and a limit piece located above the valve plate and being movable to limit the valve plate.

8 Claims, 2 Drawing Sheets

(56) References Cited

U.S. PATENT DOCUMENTS

| | | | | | |
|---|---|---|---|---|---|
| 2,737,364 | A * | 3/1956 | Handwerk | F16T 1/24 | 251/157 |
| 3,296,629 | A * | 1/1967 | Clark | E03D 1/186 | 4/333 |
| 4,291,544 | A * | 9/1981 | Larsen | F25B 49/02 | 137/413 |
| 4,646,530 | A * | 3/1987 | Huenniger | F25B 49/022 | 62/217 |
| 2001/0032669 | A1 * | 10/2001 | Stumphauzer | F16T 1/24 | 137/195 |

FOREIGN PATENT DOCUMENTS

| | | | | | |
|---|---|---|---|---|---|
| CN | 1626991 | A | * | 6/2005 | F04C 29/042 |
| CN | 201031957 | Y | * | 3/2008 | |
| CN | 101300391 | A | * | 11/2008 | E03D 9/037 |
| CN | 201796817 | U | * | 4/2011 | |
| CN | 103133858 | A | * | 6/2013 | |
| CN | 102656412 | B | * | 8/2015 | F25B 43/006 |
| CN | 206635864 | U | * | 11/2017 | |
| KR | 20010065312 | A | * | 7/2001 | |

* cited by examiner

ORIFICE SET AND CHILLER SYSTEM HAVING IT

FOREIGN PRIORITY

This application claims priority to Chinese Patent Application No. 202210231607.5, filed Mar. 10, 2022, and all the benefits accruing therefrom under 35 U.S.C. § 119, the contents of which in its entirety are herein incorporated by reference.

TECHNICAL FIELD OF INVENTION

The present invention relates to the technical field of throttling, in particular to a throttling device, and also relates to a refrigeration system equipped with the throttling device.

BACKGROUND OF THE INVENTION

In a refrigeration system, the throttling device is an important component, which mainly changes the coolant (also known as "refrigerant") passing through the throttling device from high-temperature and high-pressure liquid coolant to low-temperature and low-pressure liquid coolant. At present, there are many throttling modes, such as the modes using thermal expansion valve, electronic expansion valve, throttle orifice plate, and the like. In order to save costs, many water chillers on the market use the mode that combines throttle orifice plate with float valve. In this kind of throttling device, the opening of the throttle orifice plate affects the refrigerant flow, which is an important factor determining whether the refrigeration system can operate in reliable, stable and efficient manner.

Such throttling devices usually include floating balls, connecting rods, valve plates and orifice plates with orifices, etc., wherein the floating balls float up and down with the liquid level of the liquid refrigerant, and drive the valve plates to rotate through the connecting rods, thus controlling the opening of the valve plates and adjusting the flow area of the orifices, and thus further controlling the flow of refrigerant flowing out of the throttling device. Those skilled in the art find that conventional throttling devices operate well when the refrigeration system is under the condition of large capacity and low lift (see area A in FIG. 1). However, when the refrigeration system is under the condition of small capacity and high lift (see area B in FIG. 1), the centrifugal compressor, especially the second stage, is prone to surge due to the low flow and high pressure ratio of refrigerant gas, which leads to customer complaints. In addition, the surge will increase the operating noise, vibration and power consumption of the centrifugal compressor, and may damage the internal blades of the centrifugal compressor and even the entire centrifugal compressor in serious cases.

Therefore, there is an urgent need to find a throttling device that can avoid surge of the centrifugal compressor.

SUMMARY OF THE INVENTION

In view of the forgoing, according to a first aspect of the present invention, a throttling device is provided, which effectively solves the above problems and problems in other aspects existing in the prior art. In the throttling device according to the present invention, the throttling device comprises: a tank for accommodating liquid refrigerant, with an orifice plate arranged at an outlet of the tank; a floating ball capable of floating on the liquid level of the refrigerant; a pivot rod pivotally fixed on the tank through a pivot shaft; a connecting rod, with one end thereof fixedly connected with the floating ball, and the other end thereof fixedly connected with the pivot rod; a valve plate fixed on the pivot rod and located near an orifice of the orifice plate, wherein the valve plate is capable of adjusting the flow area of the orifice under the action of the pivot rod; and a limit piece located above the valve plate and being movable to limit the valve plate.

In another embodiment of the throttling device according to the present invention, the limit piece is a positioning bolt, which can move up and down along a chute.

In yet another embodiment of the throttling device according to the present invention, the chute has an arc shape.

In still another embodiment of the throttling device according to the present invention, the height of the chute is between the highest position and the lowest position of the orifice of the orifice plate.

In another embodiment of the throttling device according to the present invention, the connecting rod and the pivot rod are fixedly connected by a bolt.

In yet another embodiment of the throttling device according to the present invention, the connecting rod, the pivot rod and the valve plate are made of metal.

In still another embodiment of the throttling device according to the present invention, the valve plate has an arc-shaped cross section.

In another embodiment of the throttling device according to the present invention, the floating ball is a hollow metal ball or a solid non-metallic ball.

In addition, according to a second aspect of the present invention, a refrigeration system is further provided, which includes a centrifugal compressor, a condenser, an economizer, an evaporator and the aforementioned throttling device. The throttling device is communicated with the condenser through an inlet pipe, and with the economizer through the orifice of the orifice plate. The refrigeration system also includes an actuator, wherein the actuator moves the limit piece when the preset surge conditions of the centrifugal compressor are met, so as to adjust the minimum flow area of the orifice.

In another embodiment of the refrigeration system according to the present invention, the preset surge conditions are related to the current stability, motor speed or inlet guide vane opening during operation of the centrifugal compressor.

It can be appreciated that the throttling device according to the present invention provides additional gas flow for the second-stage impeller of the centrifugal compressor to suppress surge caused by insufficient gas supplement, improve the efficiency and stability of the centrifugal compressor, and reduce the sound and vibration of the water chiller under partial load. In addition, the throttling device of the present invention is reliable in operation, low in cost, and can meet the requirements of various operating conditions.

BRIEF DESCRIPTION OF THE DRAWINGS

The technical solutions of the present invention will be described in further detail below in conjunction with the accompanying drawings and embodiments, where.

DETAILED DESCRIPTION OF THE INVENTION

Several embodiments of the present invention will be described in detail below in conjunction with the accompanying drawings. The embodiments described are only examples of the present invention. In addition, in order to concisely describe these embodiments, all features actually implemented may not be fully described in the description.

In the depiction of the embodiments of the present invention, it should be appreciated that the orientation or position relationships indicated by the terms "center", "longitudinal", "transverse", "up", "down", "front", "back", "left", "right", "vertical", "horizontal", "top", "bottom", "inside", "outside" are based on the orientation or position relationships shown in the accompanying drawings, which are used only for the convenience of describing the present invention and simplifying the depiction, rather than indicating or implying that the device or component referred to must have a specific orientation, or be constructed and operated in a specific orientation, and therefore cannot be understood as a limitation on the present invention.

In addition, the terms "first", "second" and "third" are only used for descriptive purposes, and cannot be understood as indicating or implying the relative importance or implicitly indicating the number of technical features indicated. Therefore, the features defined with "first", "second" and the like can explicitly or implicitly include one or more of these features. In the depiction of the present invention, unless otherwise stated, "a plurality of" means two or more.

Furthermore, the terms "installation", "connect with" and "connection" should be understood in a broad sense. For example, it can be a fixed connection, a detachable connection, or an integral connection; or it can be a mechanical connection or an electric connection; or it can be a direct connection, an indirect connection through an intermediate media, or an internal communication between two components. For those skilled in the art, the specific meanings of the above terms in the present invention can be understood on a case-by-case basis.

At present, the throttling device in the refrigeration system can adopt the mode that combines float valve with throttle orifice plate. This kind of throttling device is simple in structure, low in cost, and does not need external signals for adjustment. However, in practical applications, those skilled in the art find that although the throttling device can automatically adjust the flow area within a certain range, its gas supplement performance is poor under some operating conditions and its ability to cope with variable operating conditions and loads is poor.

Figure 2:
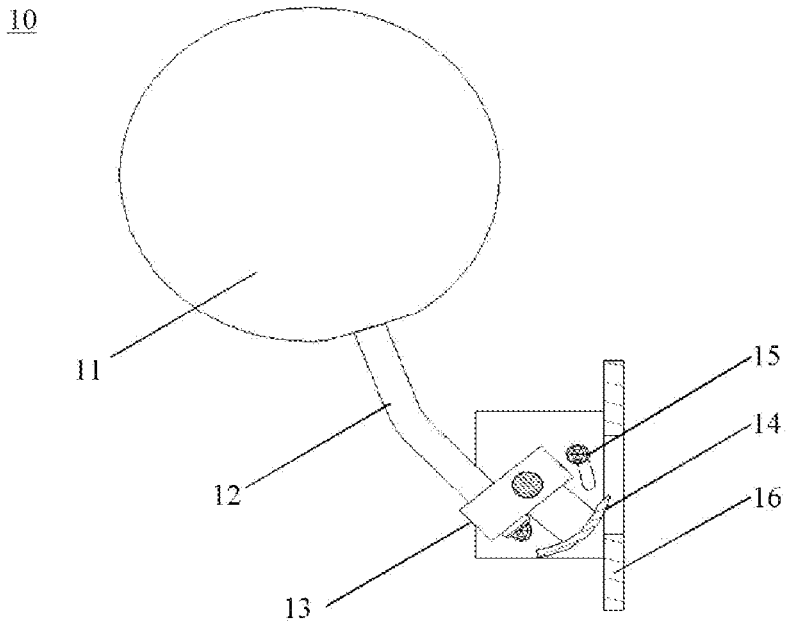
FIG. 2 shows a structural schematic diagram of an embodiment of the throttling device according to the present invention.

As shown in FIG. 2, it schematically shows the main structure of an embodiment of the throttling device according to the present invention in general. As can be clearly seen from FIG. 2, the throttling device 10 is composed of a tank, a floating ball 11, a connecting rod 12, a pivot rod 13, a valve plate 14, a limit piece 15 and an actuator (not shown) etc. The tank is used for accommodating liquid refrigerant from the condenser, with an orifice plate 16 arranged at the outlet of the tank, and is connected with the downstream economizer through a pipe. The floating ball 11 can be a hollow metal ball or a solid non-metallic ball, so that it can float on the liquid surface of the refrigerant. The pivot rod 13 can be pivotally fixed on the tank through a pivot shaft. One end of the connecting rod 12 is fixedly connected with the floating ball 11, and the other end of the connecting rod 12 is fixedly connected with the pivot rod 13 through, for example, a bolt. The valve plate 14 with, for example, an arc-shaped cross section is fixed on the pivot rod 13 and located near the orifice of the orifice plate 16, wherein the valve plate 14 can adjust the flow area of the orifice (or the throttling area) under the action of the pivot rod 13. Due to the pressure difference in the throttling process, the liquid refrigerant will generate gas after passing through the orifice plate 16 and become gas-liquid two-phase fluid.

Specifically, when the liquid level of the liquid refrigerant rises, the floating ball 11 will float up accordingly, and drive the valve plate 14 to rotate clockwise around the pivot shaft through the connecting rod 12, thus gradually opening the orifice on the orifice plate 16, where at this time, the flow area of the orifice gradually increases. When the liquid level of the liquid refrigerant drops, the floating ball 11 will float down accordingly, and drive the valve plate 14 to rotate counterclockwise around the pivot shaft through the connecting rod 12, thus gradually covering the orifice on the orifice plate 16, where at this time, the flow area of the orifice gradually decreases. The limit piece 15 is located above the valve plate 14 and can be moved to limit the valve plate 14.

Figure 1:
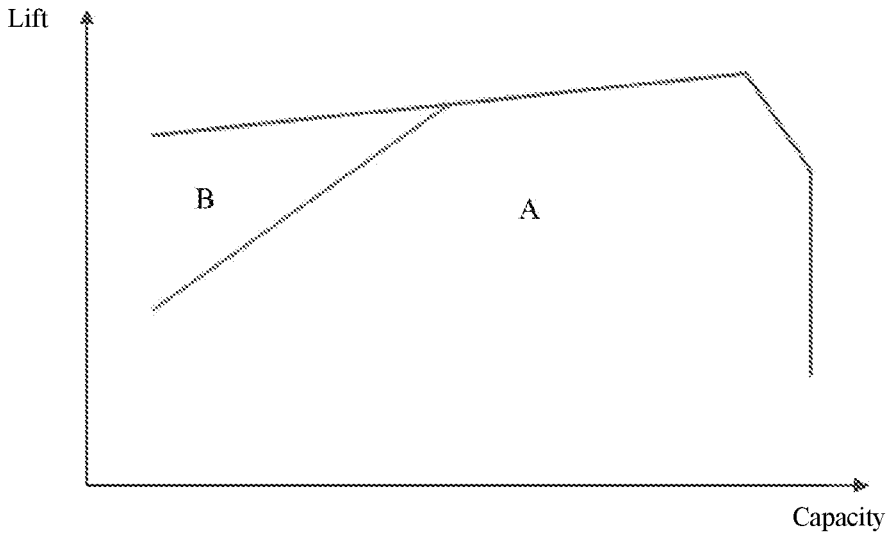
FIG. 1 shows a schematic diagram of the variation curve of the lift and capacity of the refrigeration system of the prior art.

It should be noted that the throttling device of the present invention meets the operation requirements of the unit by changing the flow area: under the condition of large capacity and low lift (see area A in FIG. 1), the orifice plate 16 of the throttling device 10 can operate as a "variable orifice plate" (herein, the term "variable orifice plate" means that the minimum flow area of the orifice is variable); whereas, under the condition of small capacity and high lift (see area B in FIG. 1), the valve plate 14 maintains a certain opening due to the effect of limit, so that the orifice plate 16 of the throttling device 10 can operate as a "fixed orifice plate" (herein, the term "fixed orifice plate" means that the minimum flow area of the orifice is fixed), thus ensuring a certain amount of hot gas bypass (HGBP, Hot Gas Bypass). Because the "fixed orifice plate" increases the minimum opening of the valve plate 14, i.e., increasing the minimum flow area, the valve plate 14 can better overcome the pressure difference before and after opening and thus is easier to open, and the flow of refrigerant becomes smoother. By detecting the parameters related to the current stability, motor speed or the opening of inlet guide vane (IGV, Inlet Guide Vane) during operation of the centrifugal compressor, it can be determined whether the preset surge conditions are met, i.e., whether the centrifugal compressor is about to be in the surge zone, or is about to be under the condition of small capacity and high lift. At this time, the actuator moves the limit piece to limit the valve plate, and controls the minimum opening of the valve plate, so that the minimum flow area of the throttling device remains unchanged. During the throttling process, more gas is generated to supplement gas to the second-stage impeller of the centrifugal compressor, so as to avoid undesired surge, thus ensuring that the refrigeration system operates in the best and safest state.

Figure 3:
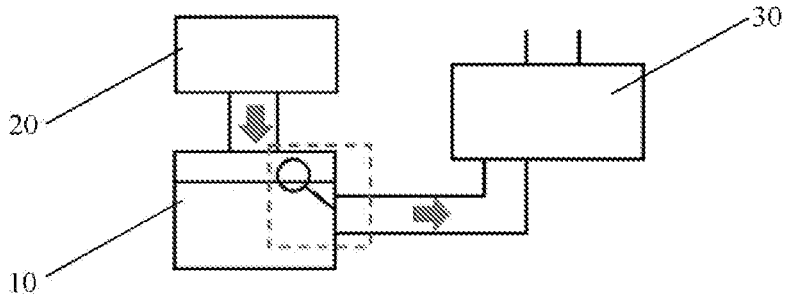
FIG. 3 shows a structural schematic diagram of the throttling device in FIG. 2 connected with the condenser and the economizer when the refrigeration system is in the condition of large capacity and low lift.
Figure 4:
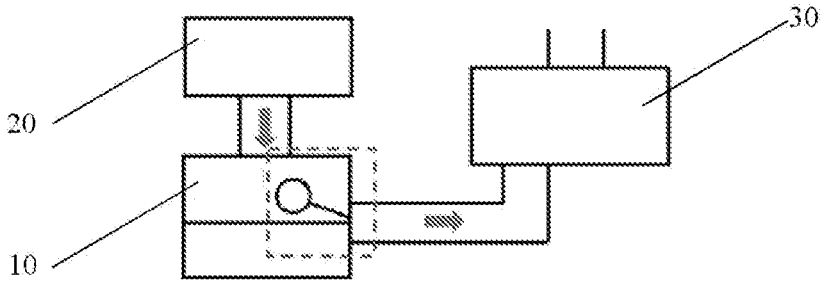
FIG. 4 shows a structural schematic diagram of the throttling device in FIG. 2 connected with the condenser and the economizer when the refrigeration system is in the condition of small capacity and high lift.

The operating conditions of the throttling device are described in detail below in conjunction with FIGS. 3 and 4.

When the refrigeration system operates under the conditions of large capacity and low lift, the hot gas bypass is minimum. At this time, the liquid level of the refrigerant is usually above the orifice of the orifice plate of the throttling device (see FIG. 3), and the flow area of the throttling device can be directly adjusted by the floating ball driving the valve plate, which is similar to the throttling device of the prior art. The flow direction of the refrigerant is shown by the arrows in FIG. 3. When the refrigeration system operates under the condition of small capacity and high lift, the throttling device needs to achieve a certain level of hot gas bypass to supplement gas for the centrifugal compressor. At this time, the refrigerant level is usually between the highest and lowest positions of the orifice of the orifice plate of the throttling device (see FIG. 4). The flow direction of the refrigerant is shown by the arrows in FIG. 4. If one or more parameters related to the current stability, motor speed and inlet guide vane opening during operation of the centrifugal compressor are detected by the detection device to exceed the preset values, it is determined that the compressor is about to be in the surge zone, or under the condition of small capacity and high lift. The actuator moves the limit piece to limit the valve plate, thus adjusting the opening of the orifice on the orifice plate, controlling the minimum flow area of the throttling device, and maintaining the minimum flow area unchanged. In this way, the efficiency can be improved by supplementing gas, and the unit can be out of the high noise vibration area. It can be seen from the above that the throttling device can be applied to refrigeration systems with different use requirements, so that the refrigeration systems can be used for various applications and meet the multi-function design requirements, thus ensuring that the refrigeration system can operate in a safe and reliable manner under different operating modes, and improving the stability and reliability of the product quality.

In combination with the above embodiments, in other preferred embodiments, the limit piece 15 of the throttling device 10 can be in the form of a positioning bolt, which can move up and down along a chute. In addition, those skilled in the art would readily understand that the height of the chute is between the highest position and the lowest position of the orifice of the orifice plate 16. Further, the chute has a roughly arc shape, so that the limit piece 15 can move along the rotation direction of the valve plate 14, as shown in FIG. 2. Certainly, the specific shape of the chute is not limited to the above arc shape, as long as the limit piece 15 can move up and down.

In addition, the present invention also provides a refrigeration system comprising the aforementioned throttling device, which is composed of a centrifugal compressor (not shown), a condenser 20, a throttling device 10, an economizer 30, an evaporator (not shown), and the like. The throttling device 10 is communicated with the condenser 20 through an inlet pipe, and with the economizer 30 through the orifice of the orifice plate 16. The centrifugal compressor sucks the low-temperature and low-pressure gas refrigerant from the evaporator, and compresses the low-temperature and low-pressure gas refrigerant into high-temperature and high-pressure gas refrigerant by doing work. The high-temperature and high-pressure gas refrigerant enters the condenser 20 to exchange heat with water and is condensed into high-pressure liquid in the condenser 20 to release a large amount of heat, the water absorbs the heat released and its temperature rises continuously, and the high-pressure liquid is throttled and depressurized by the throttling device 10 and then delivered to the economizer 30. The main function of the economizer 30 is to realize gas-liquid separation and improve the operation efficiency of the unit. The gas-liquid two-phase refrigerant enters the tank of the economizer 30 through a lead-in elbow pipe. The gaseous part of the refrigerant is completely separated from the liquid part through the structure configured in the tank of the economizer 30. The separated gaseous refrigerant enters the centrifugal compressor through the gas outlet pipe to form a secondary gas suction, and the separated liquid refrigerant flows out through the liquid outlet pipe and enters the evaporator for evaporation and refrigeration. The refrigeration system also comprises an actuator, which moves the limit piece when the preset surge conditions of the centrifugal compressor are met, so as to adjust the minimum flow area of the orifice. Further, the preset surge conditions are related to the current stability, motor speed or inlet guide vane opening during operation of the centrifugal compressor.

To sum up, the throttling device of the present invention can automatically adjust the flow in the initiating process or the partial load process and other operating conditions. Under the condition of small capacity and high lift, the minimum flow area of the orifice plate maintains unchanged; under the condition of large capacity and low lift, the minimum flow area of the orifice plate is variable. While meeting the requirements of various operating conditions of the system, it ensure that the flow area is automatically adjusted during the low-load operation phase of the system, so that the system can operate in a safe and stable manner, and prevent the surge of the centrifugal compressor caused by excessive liquid supply leading to compression with liquid, thereby achieving vibration and noise reduction. Therefore, it is recommended to apply the aforementioned throttling device to various refrigeration systems.

Some specific embodiments are listed above to illustrate in detail the throttling device and the refrigeration system equipped with the throttling device according to the invention. These individual examples are only used to illustrate the principle of the present invention and the implementations thereof, but not to limit the present invention. Those skilled in the art may, without departing from the spirit and scope of the present invention, make various modifications and improvements. For example, in order to ensure the structural strength of the internal components of the throttling device, the connecting rod 12, the pivot rod 13 and the valve plate 14 can be made of metal or other high-strength materials. Therefore, all equivalent technical solutions shall belong to the scope of the present invention and be defined by the respective claims of the present invention.

What is claimed is:

1. A throttling device, comprising:

a tank for accommodating liquid refrigerant, with an orifice plate arranged at an outlet of the tank;

a floating ball capable of floating on a liquid surface of the refrigerant;

a pivot rod pivotally fixed on the tank through a pivot shaft;

a connecting rod, with one end thereof fixedly connected with the floating ball, and the other end thereof fixedly connected with the pivot rod;

a valve plate fixed on the pivot rod and located near an orifice of the orifice plate, wherein the valve plate is capable of adjusting a flow area of the orifice under action of the pivot rod; and a limit piece located above the valve plate and being movable, the limit piece configured to limit a position of the valve plate to establish a minimum flow area of the orifice;

wherein the limit piece is a positioning bolt capable of moving up and down along a chute;

wherein the chute has an arc shape.

2. The throttling device according to claim 1, wherein the connecting rod and the pivot rod are fixedly connected by bolts.

3. The throttling device according to claim 1, wherein the connecting rod, the pivot rod and the valve plate are made of metal.

4. The throttling device according to claim 1, wherein the valve plate has an arc-shaped cross section.

5. The throttling device according to claim 1, wherein the floating ball is a hollow metal ball or a solid non-metallic ball.

6. A throttling device, comprising:

a tank for accommodating liquid refrigerant, with an orifice plate arranged at an outlet of the tank;

a floating ball capable of floating on a liquid surface of the refrigerant;

a pivot rod pivotally fixed on the tank through a pivot shaft;

a connecting rod, with one end thereof fixedly connected with the floating ball, and the other end thereof fixedly connected with the pivot rod;

a valve plate fixed on the pivot rod and located near an orifice of the orifice plate, wherein the valve plate is capable of adjusting a flow area of the orifice under action of the pivot rod; and a limit piece located above the valve plate and being movable, the limit piece configured to limit a position of the valve plate to establish a minimum flow area of the orifice;

wherein a height of the chute is between the highest position and the lowest position of the orifice of the orifice plate.

7. A refrigeration system, comprising:

a centrifugal compressor, a condenser, an economizer, an evaporator and a throttling device, the throttling device including:

a tank for accommodating liquid refrigerant, with an orifice plate arranged at an outlet of the tank;

a floating ball capable of floating on a liquid surface of the refrigerant;

a pivot rod pivotally fixed on the tank through a pivot shaft;

a connecting rod, with one end thereof fixedly connected with the floating ball, and the other end thereof fixedly connected with the pivot rod;

a valve plate fixed on the pivot rod and located near an orifice of the orifice plate, wherein the valve plate is capable of adjusting a flow area of the orifice under action of the pivot rod; and a limit piece located above the valve plate and being movable to limit the valve plate, the throttling device being communicated with the condenser through an inlet pipe, and with the economizer through the orifice of the orifice plate, wherein the limit piece of the throttling device moves when preset surge conditions of the centrifugal compressor are met, so as to adjust a minimum flow area of the orifice.

8. The refrigeration system according to claim 7, wherein the preset surge conditions are related to current stability, motor speed or inlet guide vane opening during operation of the centrifugal compressor.

* * * * *